United States Patent [19]

Ribitch

[11] Patent Number: 5,067,990

[45] Date of Patent: Nov. 26, 1991

[54] METHOD OF APPLYING PHOSPHATE CONVERSION COATINGS TO FE-R-B SUBSTRATES, AND FE-R-B ARTICLES HAVING A PHOSPHATE CONVERSION COATING THEREON

[75] Inventor: Raymond Ribitch, Mt. Pleasant, Mich.

[73] Assignee: Hitachi Metals International, Ltd., Purchase, N.Y.

[21] Appl. No.: 288,490

[22] Filed: Dec. 22, 1988

[51] Int. Cl.[5] ..... C23C 22/14

[52] U.S. Cl. ..... 148/262; 148/302; 148/254

[58] Field of Search ..... 148/302, 254, 262

[56] References Cited

U.S. PATENT DOCUMENTS 4,437,947 3/1984 Saito ..... 148/254

4,837,114 6/1989 Hamada ..... 148/302

FOREIGN PATENT DOCUMENTS 0116885 9/1981 Japan ..... 148/262

*Primary Examiner*—Sam Silverberg

*Attorney, Agent, or Firm*—Gifford, Groh, Sprinkle, Patmore and Anderson

[57] ABSTRACT

A method for applying a phosphate conversion coating atop an iron-rare earth-boron alloy not normally susceptible to phosphating includes the step of applying a compatible metal layer to the alloy substrate before phosphatizing. The metal layer can be an alloy or an elemental metal, preferably zinc or nickel, and optimally nickel. The rare earth in the alloy is optimally neodymium. Any of the conventionally known metal coating and phosphating procedures can be generally employed in the method of the invention. An article having an iron-rare earth-boron substrate and a phosphate conversion coating atop the substrate, preferably formed as the product of the disclosed method, is also disclosed.

6 Claims, No Drawings

METHOD OF APPLYING PHOSPHATE CONVERSION COATINGS TO FE-R-B SUBSTRATES, AND FE-R-B ARTICLES HAVING A PHOSPHATE CONVERSION COATING THEREON

BACKGROUND OF THE INVENTION

I. Field of the Invention

The present invention relates to coated metal substrates and more particularly to ferrous articles bearing a phosphate conversion coating thereon.

II. Description of the Prior Art

It is well known that numerous advantages can be achieved by applying a phosphate conversion to a ferrous article or substrate. Two of the most important advantages are the increased adhesion of organic coatings (such as acrylic or epoxy resins or paints) to the substrate, and the increased resistance of the phosphatized substrate (either with or without a subsequent coating) to corrosion, especially at elevated temperatures or humidities. Occasionally steel—itself already adequately susceptible to application of a satisfactory phosphate coating—has been plated with zinc prior to application of the phosphate conversion coating.

Phosphatizing is typically carried out by applying an acid solution of zinc phosphate to a susceptible substrate that has been prepared by surface grinding, acid etching, sandblasting, glass bead blasting, alkaline cleaning or the like. Nickel ion has been included in the phosphatizing solution as an accelerator. The phosphatizing solution can be applied to the prepared surface in a number of different ways, for example, as by immersion, spraying, dipping, wiping, brushing or the like.

Unfortunately, alloys composed of iron, boron, and a rare earth metal such as neodymium, which have particular utility in the magnetics industry, have been found not to be susceptible to conventional methods of phosphatizing. This has reduced the utility of Fe-R-B alloys, which have been subject to some drawbacks in use, such as a less than satisfactory resistance to moisture and corrosion, and poor adhesion of organic coatings intended to protect the alloys from such corrosion.

SUMMARY OF THE PRESENT INVENTION

Applicant has discovered that a phosphate conversion coating can be applied to Fe-R-B alloys (which, unlike steel, are not by themselves susceptible to phosphate coating) by first applying a layer of an elemental metal or an alloy which is itself susceptible to phosphate coating atop an iron-rare earth-boron (Fe-R-B) alloy substrate, and then applying a phosphate conversion coating atop the elemental metal or alloy layer. This method yields an article having the useful characteristics of conventional Fe-R-B alloy articles but which advantageously possesses a resistance to corrosion and a receptivity for organic surface coatings which are superior to those of such conventional Fe-R-B alloy articles.

The rare earth R can comprise yttrium (although not a rare earth element itself, it is chemically similar to them, is found associated with them and is separated from them only with great difficulty) or any individual rare earth element such as lanthanum, cerium, praseodymium, neodymium, promethium, samarium, europium, gadolinium, terbium, dysprosium, holmium, erbium, thulium, ytterbium or lutetium, or combinations of any of them, including commercially available mixtures such as didymium or misch metal. Indeed, as is well known, the practical difficulties encountered in separating the rare earths from one another means that the rare earth present in Fe-R-B alloys will usually be a mixture of rare earth elements, to one degree or another. Preferably, however, as is common with such alloys, neodymium or praseodymium will predominate the mixture of rare earths present, and optimally the rare earth mixture will be predominated by neodymium.

The step of coating the Fe-R-B alloy substrate with an elemental metal or an alloy can generally be carried out by any conventional electrolytic or electroless process. The elemental metal or the alloy can comprise any material compatible with both the Fe-R-B alloy and the phosphate conversion coating. It is anticipated that any metal which can achieve a plus two valence in acid solution may be a material useful for this purpose. Such metals include (but are not limited to) barium, cadmium, cobalt, copper, iron, lead, manganese, mercury, nickel, tin, zinc, silver and magnesium. Preferably, the elemental metal or alloy includes at least one of zinc and nickel, and optimally is plated nickel.

The step of applying the phosphate conversion coating can generally be carried out by any conventional phosphatizing process. Such processes often involve the application of an acid phosphate solution to the surface to be treated. Preferably, the phosphatizing solution includes a source of phosphate comprising $Zn_{3-x}M_x(PO_4)_2$, where M is one of the coating metals mentioned earlier, and x is between 0 and 3. Particularly when the elemental metal or alloy layer includes nickel, the phosphatizing solution can advantageously include nickel ion both as an accelerator and as a constituent of the phosphate source. The preferred source is thus $Zn_{3-x}Ni_x(PO_4)_2$, where x equals 1 or 2.

The present invention is also directed to an article comprising an Fe-R-B alloy substrate and having a phosphate conversion coating atop the substrate. Preferably the article comprises a core composed of the Fe-R-B substrate, an elemental metal or an alloy layer atop the substrate, and a phosphate conversion coating atop the metal or alloy layer. The preferred substrate is an Fe-Nd-B alloy, while the metal or alloy layer is the same as described above, preferably comprising at least one of zinc or nickel, optimally nickel plate. The article can be the product of the method described.

DETAILED DESCRIPTION OF THE PREFERRED EMBODIMENT OF THE PRESENT INVENTION

Articles composed of an Fe-Nd-B substrate can be coated with a metal susceptible to reception of a phosphate conversion coating, such as zinc or (preferably) nickel, in following general fashion:

EXAMPLE I

An Fe-Nd-B article can be nickel plated in the following general fashion:

1. The article is cleaned in an electrolytic alkaline cleaner. Such cleaners are well known in the plating arts.
2. The cleaned article is rinsed in tap water.
3. The rinsed article is then rinsed at least once in deionized water.
4. The article is acid-etched in 0.1% v/v to 50% v/v solution of at least one acid such as hydrochloric acid, nitric acid, phosphoric acid, acetic acid or sulfuric acid.

5. The etched substrate is then immersed in a nickel sulfamate bath, and deposition of nickel brought about by any conventional electroplating process. As is conventional, electroplating may be immediately preceded by immersion in a "strike" (preplating) bath.

EXAMPLE II

An Fe-Nd-B article can be plated with zinc metal in accordance with any common galvanizing method, for example, of the type including application of an acid solution of zinc chloride or zinc sulfate to the surface of the article.

EXAMPLES III-X

As controls, Fe-Nd-B articles were subjected to the most commonly employed pretreatment processes for preparing a susceptible surface for reception of a phosphate conversion coating: surface grinding (Example III); sandblasting (Example IV); glass bead blasting (Example V); chrome acid etching (Example VI); nitric acid etching (Example VII); sulfuric acid etching (Example VIII); phosphoric acid etching (Example IX); and hydrochloric acid etching (Example X).

Samples pretreated as in Examples I-X were then subjected to an attempt to phosphatize them employing zinc phosphate or other divalent metal phosphate in acid solution. Those articles which accepted a phosphate conversion coating were then electrocoated with an acrylic or epoxy cathodic electrocoat, such as any of a variety of conventional coatings manufactured by PPG (Pittsburg Paint & Glass), Sherwin-Williams, BASF-Inmont, Glidden and others. The specific electrocoats applied in the Examples described below included a black cathodic epoxy coating from BASF Corporation, Immont Division; a white single component coating from Sherwin Williams Chemical Coatings; and Powercron 500 and Powercron 600 from PPG Industries, Inc. The details of conventional phosphatizing and electrocoating are well known to those skilled in the art and need not be repeated here. Typically, however, procedures like the following were employed:

EXAMPLE XI

A specific procedure for providing a phosphatized coating on a nickel-plated Fe-Nd-B article is as follows:

1. An Fe-Nd-B article is soaked for cleaning in an electrolytic soak such as Endbond 808 for about 30 to 60 seconds, and then rinsed with warm water.
2. The cleaned article is rinsed in cold deionized water in an ultrasonic bath to remove any smut present. An impingement spray can instead be used for rinsing. Tap water can be employed for the rinse instead of deionized water.
3. The article is then blow dried.
4. The dried article is acid-etched in 5% v/v sulfuric acid for about 30 to 60 seconds.
5. The etched article is then plated with nickel at 25 amps for three to ten minutes.
6. The plated article is then spray cleaned or dipped in a solution of an alkaline cleaner, such as a mixture of Parker Chemical Co. Parcocleaner 2380 and 2381, at room temperature for about 90 seconds.
7. The article is optionally but preferably rinsed in warm water for about 30 seconds, if phosphatizing does not immediately follow plating.
8. The plated article is dipped in a surface conditioner such as PLN Zn (Parker Chemical Co.) below 100 degrees Fahrenheit for 30 seconds to promote phosphate nucleation.
9. The surface conditioned article is then dipped in a phosphatizing solution, for example, a zinc phospate conversion bath such as Bonderite CD-10, at about 120 to 130 degrees Fahrenheit for 120 seconds.
10. The phosphated article is then rinsed in cold water for 30 seconds, for example, by dipping.
11. The rinsed article is then sprayed with PLN 60 at 105 to 115 degrees Fahrenheit for about 30 seconds.
12. The article is then sprayed with deionized water at room temperature for about 15 seconds.

Steps 6-12 are advantageously carried out by basket dip, for example.

EXAMPLE XII

A nickel-plated, phosphate coated Fe-Nd-B article can alternatively be prepared as follows:

1-5. Steps 1-5 of Example XIII are repeated.

6. The plated article is precleaned with a 50% solution of Parco Precleaner 2960 (Parker Chemical Co.), wiped onto the article by hand at room temperature.
7. The article is then spray-cleaned with a 1.5 ounce per gallon solution of Parcocleaner 2331 (also Parker Chemical Co.) at 135 degrees Fahrenheit for about 90 seconds.
8. The cleaned article is then rinsed by spraying with warm water for 30 seconds.
9. The article is then surface conditioned by a 30 second spray of a 1.5 gram per liter solution of a surface conditioner, such as Parcolene Z8 (Parker Chemical Co.), at less than 110 degrees Fahrenheit.
10. The surface-conditioned article is then provided with a phosphate conversion coating by immersing the article in a 120 to 130 degree Fahrenheit bath of an aqueous solution of Granodine 958 for about 60 seconds. The preferred solution has a free acid content of about 0.8 to 1.1, a total acid content of about 22 to 26, and an accelerator of about 2 to 3. Granodine 952 is also useful, having a total acid content of from 18 to 22.
11. The phosphated article is then rinsed with a 30 second spray of cold water.
12. The article is then sprayed with an aqueous solution of Parcolene 80 for about 30 seconds at 105 to 115 degrees Fahrenheit. Preferably, the solution is about 4.5 to 5.5 pints per gallon and has a pH of between 5.0 and 5.5.
13. The phosphated article is then rinsed by spraying with deionized water at room temperature for about 30 seconds.

EXAMPLE XIII

A more specific method of providing an Fe-Nd-B article with a phosphate conversion coating atop a zinc plated layer is as follows:

1. The Fe-Nd-B article is acid etched in 5% v/v sulfuric acid for about 30 to 60 seconds.
2. The article is then zinc plated in the conventional fashion in an acid bath containing zinc chloride or zinc sulfate.

3. If any white zinc rust is present after plating, the article is cleaned or pickled with a mild pickling solution, for example, Parkocleaner 241.
4. The plated article is then rinsed with fresh water.
5. The plated article is again cleaned by spraying with an alkaline cleaner such as Parcocleaner 2331 (Parker Chemical Co.) at about 155 degrees Fahrenheit for about 60 seconds.
6. The cleaned article is rinsed in warm water.
7. The article is then sprayed with an activator for phosphate nucleation, for example, Parcolene Z (Parker Chemical Co.), for about 30 seconds at about 100 degrees Fahrenheit.
8. The zinc plated layer is phosphatized by spraying with a phosphatizing agent such as Bonderite 411 NF for about 60 seconds.
9. The phosphatized article is then sprayed with a cold water rinse.
10. The surface of the article is then sealed by spraying with a sealer at room temperature for about 30 seconds, for example, with a sealer such as Parcolene 60 sealer ($Cr+^3/Cr+^6$ sealer). This preferred sealer is composed of make up (Parcolene 60A) and replenishing (Parcolene 60B) chemicals from Parker Chemical Co. which serve to apply a chromate conversion coating to the phospated article surface.
11. The phosphated and sealed article is then rinsed in deionized water and blown dry.

RESULTS

Fe-Nd-B articles subjected to the some of the pretreatment and phosphatizing described in the foregoing Examples were thereafter coated with an acrylic or epoxy cathodic electrocoat. The parts so treated were then subjected to ASTM Humidity Test D2247 (80 degrees Centigrade at 95% relative humidity) for between 100 and 500 hours, then subjected to ASTM Tape Test 3359. This tape test involves applying 3M 898 adhesive tape to a previously cross-hatched electrocoated surface, and observing the damage which occurs to the surface when the tape is removed.

Articles prepared in accordance with Examples III–V, in which the Fe-Nd-B substrate was merely surface ground or sand or bead blasted and not otherwise treated, all gave a 0B result on the tape test after 500 hours. Further, each was evaluated for blistering according to the ASTM Blister Test after 500 hours, and dense blisters rating 2D or 8D were present.

Other unplated controls, chrome or sulfuric acid-etched in accordance with Examples VI and VIII, provided only marginally better results. In less than 500 hours of the humidity test, the application of all coatings but the PPG electrocoat yielded a 0B result on the tape test. After 500 hours, the PPG electrocoat yielded between a 1B and a 2B tape test result. The results of the blister tests were mixed but poor. Results between a rusted surface to a 2F (fine) blistered surface were observed.

The foregoing results make it clear that Fe-Nd-B substrates, when treated in the conventional fashions, do not accept phosphate conversion coatings. Observation of the substrate surfaces by scanning electron microscope disclosed the absence of any formation of a phosphate conversion coating on those surfaces. Such absence was confirmed by KEVEX analysis of the elemental content of those sufaces. Conventional phosphatizing processes therefore cannot give Fe-R-B alloys the advantages accruing from phosphatization.

In contrast, the nickel plated and phosphate coated article treated in accordance with Example XI yielded the best possible result, (5B), on the tape test after 500 hours of the humidity test. Samples so treated also had no blisters or at worst only a very few blisters after 500 hours of the humidity test.

The stark contrast of the results obtained from metal plating the Fe-Nd-B substrate prior to phosphatizing, in contrast to the same method of phosphatizing carried out on an unplated substrate, clearly demonstrates that plating such a substrate with a metal or alloy which can receive a phosphate conversion coating yields an Fe-Nd-B article which is much more resistant to corrosion and which better accepts organic coatings than similar substrates which are not metal plated. Of course, the plating and coating do not substantially adversely affect the structural and magnetic characteristics of the article.

It is thus the primary advantage of the present invention that it provides an article having the structural and magnetic characteristics of a conventional Fe-R-B alloy article, while simultaneously possessing a resistance to corrosion and a receptivity for organic coatings which are superior to those of conventional Fe-R-B alloy articles. Although they may have somewhat differing magnetic characteristics, the similarities of the chemical characteristics of yttrium and the rare earth elements demonstrates the utility of the present invention for treating Fe-R-B alloys in which R is other than neodymium. This is buttressed by the well known fact that alloys of this type of necessity often contain admixtures of yttrium and rare earth elements. The use of Fe-Nd-B alloys as examples herein is not intended to and does not suggest that the utility of the present invention is limited only to alloys containing neodymium and not other rare earth elements.

Indeed, other rare-earth alloys may be phosphatized in a similar fashion. For example, an article having a cobalt-samarium or cobalt-praseodymium core can be nickel plated in a fashion similar to that employed for Fe-R-B alloys.

Having described my invention, however, many modifications thereto will become apparent to those skilled in the art to which it pertains, without deviation from the spirit of the present invention, as defined by the scope of the appended claims.

I claim:

1. A method of providing a phosphate conversion corrosion resistant coating over an iron-rare earth-boron alloy substrate, said substrate being itself not directly susceptible to phosphatizing, comprising the steps of:

activating said substrate in a sulphuric acid or nitric acid;

layering said substrate with a nickel by an electrolytic or electroless process from an acid solution, said nickel being susceptible to application of a phosphate conversion coating; and applying a phosphate conversion coating to said layered nickel.

2. The invention according to claim 1, wherein said substrate is an Fe-Nd-B alloy.

3. The invention according to claim 1, wherein said phosphate applying step is carried out by application of a phosphatizing solution to said layered metal.

4. The invention according to claim 3, wherein said solution comprises an acid solution of a zinc phosphate.

5. The invention according to claim 4, wherein said zinc phosphate comprises $Zn_{3-x}Ni_x(PO_4)_2$, wherein x is less than 3.

6. The invention according to claim 5, wherein x equals 1 or 2.

* * * * *